US008823278B2

(12) United States Patent
Iwai et al.

(10) Patent No.: US 8,823,278 B2
(45) Date of Patent: Sep. 2, 2014

(54) DC POWER SOURCE UNIT AND LED LAMP SYSTEM

(75) Inventors: Naoko Iwai, Yokosuka (JP); Toshihiko Sasai, Yokosuka (JP); Masahiko Kamata, Yokosuka (JP); Hiroshi Terasaka, Yokosuka (JP); Toru Ishikita, Yokosuka (JP); Hitoshi Kawano, Yokosuka (JP); Masatoshi Kumagai, Yokosuka (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 367 days.

(21) Appl. No.: 13/218,767

(22) Filed: Aug. 26, 2011

(65) Prior Publication Data

US 2012/0056560 A1 Mar. 8, 2012

(30) Foreign Application Priority Data

Aug. 26, 2010 (JP) ..... 2010-188971

(51) Int. Cl.
*H05B 37/02* (2006.01)
*H05B 33/08* (2006.01)

(52) U.S. Cl.
CPC ..... *H05B 33/0815* (2013.01); *H05B 33/0818* (2013.01)
USPC ..... 315/291; 315/224; 315/308

(58) Field of Classification Search
USPC ..... 315/291, 224, 219, 307, 308, 185 R, 315/193, 186
See application file for complete search history.

(56) References Cited

U.S. PATENT DOCUMENTS

| | | | | |
|---|---|---|---|---|
| 6,113,760 | A | 9/2000 | Kuriyama | |
| 2004/0196225 | A1 | 10/2004 | Shimoda | |
| 2008/0018261 | A1 | 1/2008 | Kastner | |
| 2011/0115412 | A1 * | 5/2011 | Welten | 315/307 |

FOREIGN PATENT DOCUMENTS

| | | |
|---|---|---|
| CN | 101711075 | 5/2010 |
| EP | 2315497 | 4/2011 |
| JP | 2010-021109 | 1/2009 |
| JP | 2009-134933 | 6/2009 |
| JP | 2010-040400 | 2/2010 |
| JP | 2010-110157 | 5/2010 |
| JP | 2010-118319 | 5/2010 |
| TW | 20100506 | 3/2010 |
| WO | WO 2009/001279 | 12/2008 |
| WO | WO 2010/005291 | 1/2010 |

OTHER PUBLICATIONS

U.S. Appl. No. 12/942,055 as of Oct. 21, 2013.
U.S. Appl. No. 13/013,271 as of Oct. 21, 2013.
U.S. Appl. No. 13/162,678 as of Oct. 21, 2013.

(Continued)

*Primary Examiner* — David H Vu
(74) *Attorney, Agent, or Firm* — DLA Piper LLP (US)

(57) ABSTRACT

A DC power source unit 37 is provided which boosts source voltage from a power source portion 36. A lighting circuit 38 is provided which supplies DC voltage to loads, the DC voltage being obtained by stepping down output current of the DC power source circuit 37. A control circuit 39 is provided which controls the lighting circuit 38 in accordance with at least either voltage or current of LEDs 25 and controls the DC power source unit 37 so that a ratio of output voltage to voltage of the LEDs 25 becomes a preset fixed ratio.

10 Claims, 2 Drawing Sheets

(56) References Cited

OTHER PUBLICATIONS

U.S. Appl. No. 13/106,487 as of Oct. 21, 2013.
European Search Report issued in EP 11177418.8 on Aug. 2, 2013.
Chinese Office Action issued in CN 201110247190 on Sep. 6, 2013.
English Language Translation of Chinese Office Action issued in CN 201110247190 on Sep. 6, 2013.
English Language Abstract of TW 201010506 published on Mar. 1, 2010.
English Language Abstract of CN 101711075 published on May 19, 2010.
U.S. Appl. No. 12/942,055 as of Jul. 12, 2013.
U.S. Appl. No. 13/013,271 as of Jul. 12, 2013.
U.S. Appl. No. 13/162,678 as of Jul. 12, 2013.
U.S. Appl. No. 13/169,748 as of Jul. 12. 2013.
European Search Report issued in EP 11177418 on Dec. 6, 2011.
English Language Abstract of JP 2010-110157 published May 13, 2010.
English Language Translation of JP 2010-110157 published May 13, 2010.
U.S. Appl. No. 12/942,055 as of Apr. 4, 2013.
U.S. Appl. No. 13/013,271 as of Apr. 4, 2013.
U.S. Appl. No. 13/106,487 as of Apr. 4, 2013.
U.S. Appl. No. 13/162,678 as of Apr. 4, 2013.
U.S. Appl. No. 13/169,748 as of Apr. 4, 2013.
Japanese Office Action issued in JP2010-188971 on Nov. 13, 2013.
English Language Translation of JP Japanese Office Action issued in JP2010-188971 on Nov. 13, 2013.
English Language Abstract and Translation of JP 2009-134933 published Jun. 18, 2010.
English Language Abstract and Translation of JP 2010-040400 published on Feb. 18, 2010.
European Office Action issued in EP 11 152 006.0 dated Nov. 5, 2013.
U.S. Appl. No. 12/942,055 as of Feb. 7, 2014 between Nov. 7, 2013 and Feb. 7, 2014.
U.S. Appl. No. 13/013,271 as of Feb. 7, 2014 between Nov. 7, 2013 and Feb. 7, 2014.
U.S. Appl. No. 13/106,487 as of Feb. 7, 2014 between Nov. 7, 2013 and Feb. 7, 2014.
Japanese Office Action issued in JP 2010-188971 on Mar. 19, 2014.
English Language Translation of Japanese Office Action issued in JP 2010-188971 on Mar. 19, 2014.
English Language Abstract and Translation of JP 2010-118319 published on May 27, 2010.
English Language Abstract and Translation of JP2010-021109 published on Jan. 28, 2010.
Chinese Office Action issued in CN 201110247190.3 on Mar. 10, 2014.
English Language Translation of Chinese Office Action issued in CN 201110247190.3 on Mar. 10, 2014.
U.S. Appl. No. 12/942,055 as of Apr. 24, 2014 between Jan. 24 and Apr. 24, 2014.
Decision of Refusal issued in JP 2010-188971 dated Jul. 9, 2014.
English Language Translation of Decision of Refusal issued in JP 2010-188971 dated Jul. 9, 2014.
U.S. Appl. No. 12/942,055 as of Jul. 16, 2014 between Apr. 16, 2014 and Jul. 16, 2014.

* cited by examiner

DC POWER SOURCE UNIT AND LED LAMP SYSTEM

INCORPORATION BY REFERENCE

The present invention claims priority under 35 U.S.C. §119 to Japanese Patent Application No. 2010-188971 filed on Aug. 26, 2010. The content of the application is incorporated herein by reference in their entirety.

TECHNICAL FIELD

The present invention relates to a DC power source unit having a load control circuit for supplying DC voltage to loads, the DC voltage being obtained by stepping down output voltage of a DC power source circuit, and to an LED lamp system including the DC power source unit.

BACKGROUND OF THE INVENTION

Lamp devices housing DC power source circuits and lighting circuits for lighting LEDs by DC power output from the DC power source circuits may be used in place of, for example, a straight-tube type or self-ballasted fluorescent lamp. The LEDs of the lamp device may each low power consumption and a long life. The lamp device detects voltage or current of the connected LEDs, performs feedback control on the lighting circuit and thus stably controls lighting of the LEDs. In this case, the DC power source circuit makes output voltage fixed or variable regardless of the voltage of the LEDs.

DETAILED DESCRIPTION OF THE PREFERRED EMBODIMENTS

A DC power source unit of an embodiment includes: a DC power source circuit for boosting source voltage; a load control circuit for supplying DC voltage to loads, the DC voltage being obtained by stepping down output voltage of the DC power source circuit; and a control circuit for controlling the load control circuit in accordance with at least either voltage or current of the loads and controlling the DC power source circuit so that a ratio of the output voltage to the voltage of the loads becomes a preset fixed ratio.

Figure 1:
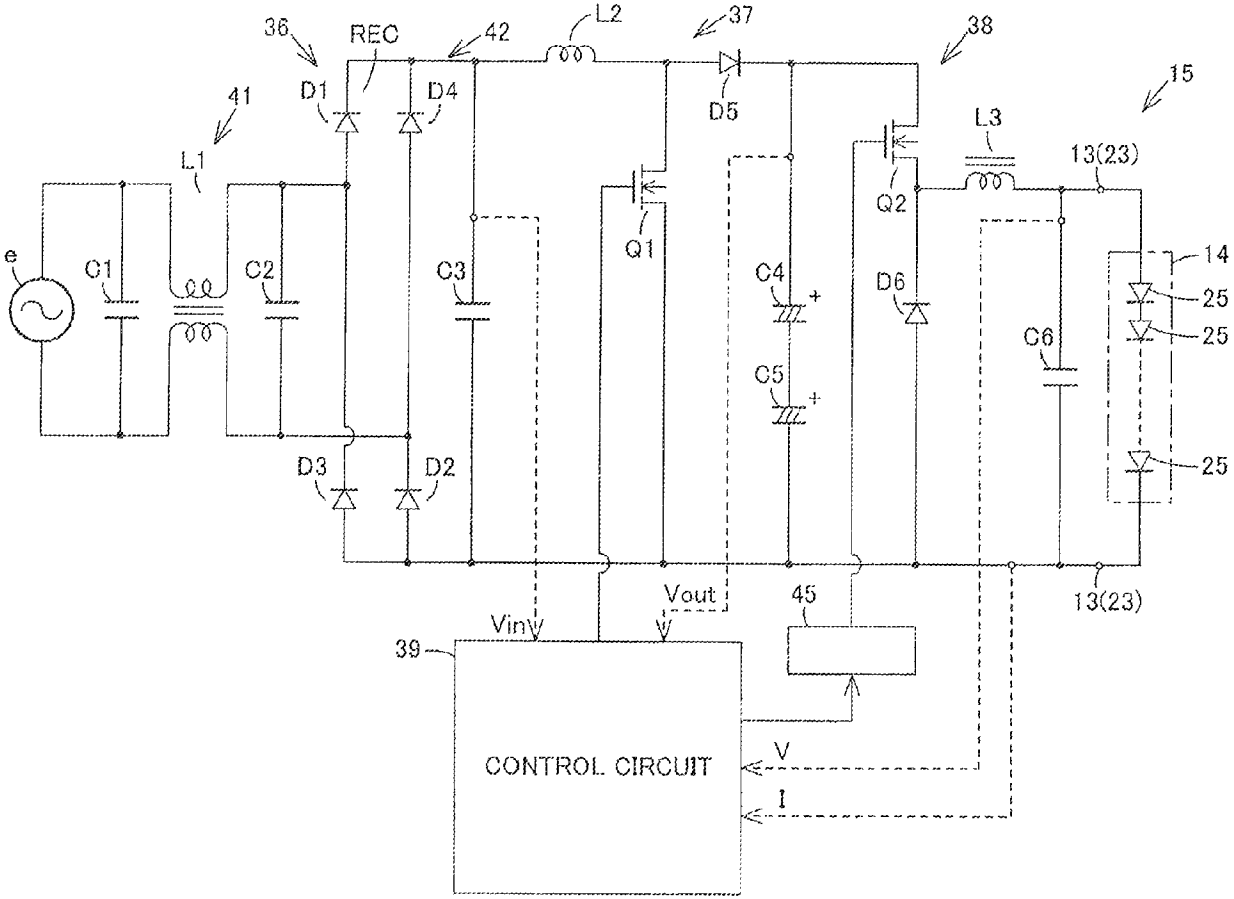
FIG. 1 is a circuit diagram illustrating a DC power source unit of an embodiment.

The embodiment will be described below with reference to FIGS. 1 and 2.

Figure 2:
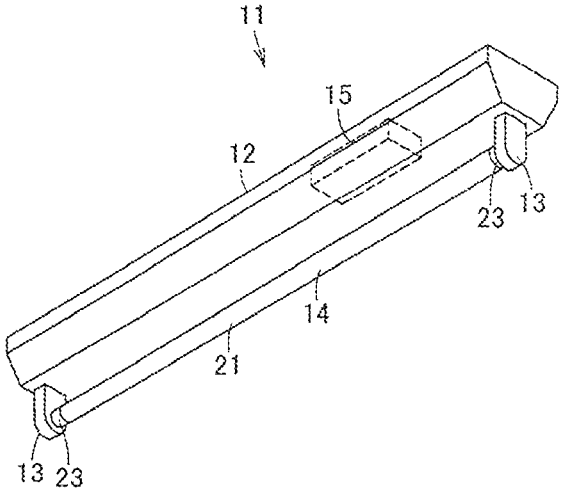
FIG. 2 is a side view of an LED lamp system including a power source unit for LED lamps.

In FIG. 2, the reference numeral 11 denotes an LED lamp system, and the LED lamp system 11 corresponds to, for example, a single straight-tube type fluorescent lamp and includes: a long fixture body 12 as a system body; a pair of sockets 13 as light source attaching units disposed opposite each other at both ends of the fixture body 12; a (straight-tube type) LED lamp 14 as a straight-tube type light source, a lamp, connected between the pair of sockets 13; and a DC power source unit 15 which is arranged in the fixture body 12 and is a dedicated power source as a lighting device for supplying power to and lighting the LED lamp 14.

The LED lamp system 11 of the embodiment is, for example, a renewal system that uses the fixture body 12 of an existing lighting fixture using a straight-tube type fluorescent lamp as it is and uses the LED lamp 14 and the DC power source unit 15. Alternatively, in the case where the LED lamp system 11 using the LED lamp 14 and the DC power source unit 15 is newly installed, it is installed as the LED lamp system 11 reusing the fixture body 12 and the sockets 13 dedicated to the LED lamp system 11 of an existing lighting fixture structure using a straight-tube type fluorescent lamp, and using the LED lamp 14 and the DC power source unit 15.

The sockets 13 are attached to both ends of a main body portion of the fixture body 12. Terminals are built in one of the sockets 13, the DC power source unit 15 is connected to the terminals, and the other socket 13 is properly used, for example, used only for holding the LED lamp 14 or used for ensuring an earth connection of the LED lamp 14.

The LED lamp 14 includes, for example, a cylindrical straight-tube type tube body 21 having transmittance, a light emitting module (not shown) housed in the tube body 21 and connection portions 23 which are attachment portions provided at both ends of the tube body 21.

The tube body 21 is made of glass or resin having transmittance and diffuseness, and formed in a long cylindrical shape having substantially the same tube length, tube diameter and appearance as those of a straight-tube type fluorescent lamp. The connection portions 23 are provided at both ends of the tube body 21.

The light emitting module includes: a slender substrate (not shown) arranged along a tube axial direction of the tube body 21 and LEDs 25 as loads mounted on the substrate along a longitudinal direction of the substrate. Light may be emitted mainly from a predetermined direction of the tube body 21 by making the substrate of the light emitting module flat and mounting the LEDs 25 on one face of the flat substrate. Alternatively, light may be emitted from the whole circumference of the tube body 21 by forming the substrate in a polygonal cylindrical shape and mounting the LEDs 25 on the periphery of the polygonal cylindrical-shaped substrate. In the LED 25, an LED chip emitting blue light is sealed with transparent resin containing fluorescent matter which is excited by blue light to emit yellow light, and white light is emitted from a surface of the transparent resin. Moreover, in FIG. 1, although the plurality of LEDs 25 are connected in series to each other, for example, only one LED 25 may be used.

The connection portion 23 shown in FIG. 2 is connected to the socket 13, for example, formed of insulative synthetic resin in the same shape as that of a cap of a straight-tube type fluorescent lamp, and attached and fixed to the end of the tube body 21. A pair of lamp pins (not shown) as power receiving portions similar to lamp pins of the straight-tube type fluorescent lamp is projected on an end face of the connection portion 23. Moreover, the connection portion 23 is not limited to being constituted by the pair of lamp pins, and may be constituted by a single lamp pin or the like. Any constitution is applicable to the connection portion 23 as long as it can realize electric connection or support of the connection portion 23 with respect to the socket 13. Additionally, the connection portion 23 may be electrically and physically connected to the socket 13 via, for example, an adaptor.

The LED lamp 14 has substantially the same outer diameter and total luminous flux as those of, for example, an existing straight-tube type fluorescent lamp.

The DC power source unit 15 has: a power source portion 36 connected to a commercial AC power source e; a DC power source circuit 37 as a step-up chopper circuit which is connected to the power source portion 36 and outputs DC voltage; a lighting circuit 38 as a load control circuit which is a step-down chopper circuit electrically connected to the DC power source circuit 37; and a control circuit 39 for controlling the DC power source circuit 37 and the lighting circuit 38.

The power source portion 36 includes a noise filter circuit 41 and a rectifying and smoothing circuit 42 connected to the noise filter circuit 41.

The noise filter circuit 41 is a line filter constituted by a capacitor C1, a common mode choke coil L1 and a capacitor C2. The noise filter circuit 41 prevents high frequency noise, which is generated from the DC power source circuit 37, the lighting circuit 38 and the like, from being output to the commercial AC power source e side.

The rectifying and smoothing circuit 42 includes a full-wave rectifying element REC such as a bridge diode connected to an output side of the noise filter circuit 41 and a smoothing capacitor C3 for smoothing output power from the full-wave rectifying element REC.

The full-wave rectifying element REC is, for example, a bridge circuit constituted by four diodes D1 to D4 as rectifying elements.

The DC power source circuit 37 is a step-up chopper circuit, power factor correction circuit, for converting output voltage of the power source portion 36 to a desired voltage, converts AC power having an AC sine wave or AC rectangular wave to DC power and supplies the DC power to the lamp pins of the LED lamp 14 through the socket 13. Moreover, for example, the DC power source circuit 37 may be connected to an output side of an AC power source such as a fluorescent lamp lighting device for outputting AC power from a commercial AC power source.

In the DC power source circuit 37, a series circuit of a chopper choke L2, which is a boosting transformer, and a reverse blocking diode D5 is electrically connected between an output side of the rectifying and smoothing circuit 42 and the lighting circuit 38, a MOSFET Q1, which is a chopping switching element as a (first) switching element, is electrically connected in parallel to a connection point of the chopper choke L2 and an anode of the diode D5, and a series circuit of electrolytic capacitors C4 and C5, which are smoothing capacitors, is electrically connected to a cathode side, which is an output side, of the diode D5.

A primary winding of the chopper choke L2 is electrically connected between an output side of the full-wave rectifying element REC and the anode of the diode D5, and one end side of a secondary winding (not shown) thereof is electrically connected to a ground potential.

A drain terminal of the MOSFET Q1 is electrically connected to the connection point of the chopper choke L2 and the anode of the diode D5, a source terminal, which is an output side, thereof is electrically connected to the ground potential and a gate terminal, which is a control terminal, thereof is electrically connected to the control circuit 39.

The lighting circuit 38 includes: a series circuit of a MOSFET Q2, which is a lighting switching element as a (second) switching element, and a diode D6, the series circuit being electrically connected between both ends of the DC power source circuit 37; an inductor L3 electrically connected to a connection point of the MOSFET Q2 and the diode D6; and a smoothing capacitor C6 electrically connected to the inductor L3 and smoothing output current, and is, for example, a step-down chopper circuit, diode rectification type step-down DC-DC converter, which steps down an output voltage of 141V to 415V of the DC power source circuit 37 to 45V to 100V and outputs a predetermined constant current. The MOSFET Q2, the diode D6 and the DC power source circuit 37 constitute a step-up/down type DC power source portion, and the inductor L3 and the smoothing capacitor C6 constitute a main circuit for lighting the LEDs 25.

A gate terminal, which is a control terminal, of the MOSFET Q2 is electrically connected to a switching control unit (high side driver) 45 which is a drive element, and the MOSFET Q2 is turned on/off at high speed by a signal from the switching control unit 45. The switching control unit 45 is electrically connected to the control circuit 39.

An anode of the diode D6 is grounded, and a cathode thereof is electrically connected to the MOSFET Q2. That is, the diode D6, the inductor L3, the smoothing capacitor C6 and the LEDs 25 form a closed circuit when the MOSFET Q2 is turned off.

The control circuit 39 is, for example, a microcomputer, can detect input voltage Vin of the DC power source circuit 37, output voltage Vout of the DC power source circuit 37 and voltage V (and current I) of the LEDs 25, performs feedback control on the lighting circuit 38 based on the voltage V (and/or the current I) and controls the DC power source circuit 37 based on the voltage V. Specifically, the control circuit 39 controls a switching frequency of the MOSFET Q2 of the lighting circuit 38 by the switching control unit 45 in accordance with the voltage V of the LEDs 25, and controls a switching frequency of the MOSFET Q1 of the DC power source circuit 37 so that a ratio of the output voltage Vout of the DC power source circuit 37 to the voltage V becomes a preset fixed ratio.

Moreover, the voltage V of the LEDs 25 in the embodiment represents voltage of the LEDs 25 as one connected in series to each other. In other words, the voltage V of the LEDs 25 is equivalent to DC voltage output from the lighting circuit 38. Accordingly, in the case of using only one LED 25, the voltage V is voltage of the one LED 25.

Next, operation of the LED lamp system 11 of the embodiment will be described.

When the LED lamp system 11 is started up, the control circuit 39 starts up to make the MOSFET Q1 of the DC power source circuit 37 perform switching operation at a predetermined switching frequency, noise is removed by the noise filter circuit 41, voltage that is output from the power source portion 36 and rectified and smoothed by the rectifying and smoothing circuit 42 is boosted by the DC power source circuit 37, and the output voltage Vout that is DC voltage smoothed by the electrolytic capacitors C4 and C5 is output so as to be input to the lighting circuit 38. At the same time, the power factor is improved in the DC power source circuit 37. Moreover, in the DC power source circuit 37, as the input voltage Vin is higher (lower), the output voltage Vout is higher (lower) (the output voltage Vout continuously becomes higher (lower)). Alternatively, when the input voltage Vin is higher (lower) than a predetermined upper limit threshold (a plurality of upper limit thresholds different from each other may be set), the output voltage Vout becomes higher (lower) (the output voltage Vout becomes higher (lower) step by step).

Then, in the lighting circuit 38, the switching control unit 45 is driven by a frequency signal generated by the control circuit 39, and thus the MOSFET Q2 is turned on/off at a predetermined switching frequency and DC voltage (output voltage Vout) smoothed by the smoothing capacitor C6 and input is converted to stepped down DC voltage (voltage V). The DC voltage V is supplied to light the LEDs 25.

In the control circuit 39, a frequency signal to be supplied to the switching control unit 45 is generated based on the detected voltage V (and/or current I) of the LEDs 25, and thus the feedback control is performed so that output current of the lighting circuit 38 becomes fixed. Accordingly, the LEDs 25 are stably lit by constant current.

Additionally, in the control circuit 39, the switching frequency of the MOSFET Q1 of the DC power source circuit 37 is controlled so that a ratio of the output voltage Vout of the DC power source circuit 37 to the detected voltage V of the LEDs 25 becomes a preset fixed ratio. For example, when the voltage V of the LEDs 25 is relatively low (high), the control circuit 39 relatively lowers (raises) the switching frequency of the MOSFET Q1 of the DC power source circuit 37, and relatively decreases (increases) the output voltage Vout of the DC power source circuit 37.

The lighting circuit 38 is thus controlled in accordance with at least either the voltage V or current I of the LEDs 25, and the DC power source circuit 37 is controlled so that the ratio of the output voltage Vout to the voltage V of the LEDs 25 becomes the preset fixed ratio. Thus, the output voltage Vout of the DC power source circuit 37 can be continuously changed in accordance with change of the voltage V, an input/output voltage difference (difference between the output voltage Vout and the voltage V) of the lighting circuit 38 is suppressed while lighting of the LEDs 25 is stably controlled, and circuit efficiency of the lighting circuit 38 can be improved.

Since the DC power source unit 15 which improves the circuit efficiency of the lighting circuit 38 while stably controlling lighting of the LEDs 25 is provided, reliability of the LED lamp system 11 can be improved.

Moreover, in the above embodiment, the control circuit 39 may control the switching frequency of the MOSFET Q1 of the DC power source circuit 37 so that the output voltage Vout of the DC power source circuit 37 is increased/decreased in accordance with a difference between the voltage V of the LEDs 25 and a predetermined threshold Vth. That is, the control circuit 39 may change, step by step, the output voltage Vout of the DC power source circuit 37 in accordance with the voltage V, for example, lowers (raises) the switching frequency of the MOSFET Q1 of the DC power source circuit 37 and decreases (increases) the output voltage Vout of the DC power source circuit 37 when the voltage V is lower (not lower) than the predetermined threshold Vth. Here, a plurality of predetermined thresholds Vth different from each other may be set. In this case, the input/output voltage difference (difference between the output voltage Vout and the voltage V) of the lighting circuit 38 is suppressed while lighting of the LEDs 25 is stably controlled, the circuit efficiency of the lighting circuit 38 can be improved, and the DC power source circuit 37 can be further easily controlled by the control circuit 39.

The control circuit 39, in accordance with, for example, a dimming signal transmitted from a dimming control circuit (not shown), may vary constant current output from the lighting circuit 38.

In place of the straight-tube type LED lamp 14, an annular type, self-ballasted or the like LED lamp can be used.

A multi-light type lighting fixture may be used which uses a plurality of pairs of sockets 13. Additionally, not only a ceiling direct mounting type lighting fixture but also an embedding type lighting fixture can be used.

Power may be supplied to the LED lamp 14 from both the pair of sockets 13 or one of the pair of sockets 13. When power is supplied from one of the sockets 13, the other socket 13 may be used only for supporting an end of the LED lamp 14. Alternatively, it is allowed that, for example, a dimming signal is transmitted from the other socket 13 to the LED lamp 14 and the LEDs 25 are dimmed by a dimming circuit built in the LED lamp 14. Additionally, without use of the sockets 13, power may be supplied from a non-contact power supplying portion arranged at the fixture body 12 side to a non-contact power receiving portion arranged at the LED lamp 14 side in a non-contact form by a dielectric coupling method or the like. Further, the sockets 13 may be used only for supporting the LED lamp 14 and another power supplying method may be used for the LED lamp 14.

Additionally, a load is not limited to the LED 25, and other options are available as long as the load is driven by DC voltage.

What is claimed is:

1. A DC power source unit comprising:

a DC power source circuit configured to boost source voltage, the DC power source circuit comprising a step-up chopper circuit;

a load control circuit configured to supply DC voltage to loads, the DC voltage being obtained by stepping down output voltage of the DC power source circuit; and a control circuit configured to control the load control circuit in accordance with at least either voltage or current of the loads, and configured to control the DC power source circuit so that a ratio of the output voltage of the DC power source circuit to the voltage of the loads becomes a preset fixed ratio.

2. The DC power source unit according to claim 1, wherein the control circuit is configured to control a switching frequency of the DC power source circuit so that the output voltage of the DC power source circuit is alternately increased/decreased in accordance with a difference between the voltage of the loads and a predetermined threshold, whereby a ratio of the output voltage of the DC power source circuit to the voltage of the loads becomes a preset fixed ratio.

3. The DC power source unit according to claim 1, wherein the load control circuit is a step-down chopper circuit.

4. The DC power source unit according to claim 1, wherein the control circuit is configured to perform feedback control so that output current of the load control circuit is constant based on detected voltage of the loads.

5. An LED lamp system comprising:

the DC power source unit according to claim 1; and

LEDs as loads which are lit by DC voltage from a load control circuit of the DC power source unit.

6. An LED lamp system comprising:

the DC power source unit according to claim 2; and

LEDs as loads which are lit by DC voltage from a load control circuit of the DC power source unit.

7. An LED lamp system comprising:

the DC power source unit according to claim 3; and

LEDs as loads which are lit by DC voltage from a load control circuit of the DC power source unit.

8. An LED lamp system comprising:

the DC power source unit according to claim 4; and

LEDs as loads which are lit by DC voltage from a load control circuit of the DC power source unit.

9. The DC power source unit according to claim 1, wherein the load control circuit steps down an output voltage of the DC power source circuit of 141V to 415V to a voltage of 45V to 100V.

10. An LED lamp system comprising:

the DC power source unit according to claim 9; and

LEDs as loads which are lit by DC voltage from a load control circuit of the DC power source unit.

* * * * *